United States Patent [19]

Stewart et al.

[11] Patent Number: 4,656,854

[45] Date of Patent: Apr. 14, 1987

[54] ROLLING MILL ECCENTRICITY COMPENSATION USING MEASUREMENT OF SHEET TENSION

[75] Inventors: D. Fred Stewart, Export; Dickon T. Oliver, Pittsburgh, both of Pa.

[73] Assignee: Aluminum Company of America, Pittsburgh, Pa.

[21] Appl. No.: 773,295

[22] Filed: Sep. 6, 1985

[51] Int. Cl.[4] ..... B21B 37/06

[52] U.S. Cl. ..... 72/8; 72/17; 72/205; 364/472

[58] Field of Search ..... 72/8, 11, 16, 21, 205, 72/17; 364/472

[56] References Cited

U.S. PATENT DOCUMENTS

| | | | |
|---|---|---|---|
| 3,740,983 | 6/1973 | Peterson et al. | 72/16 |
| 4,188,809 | 2/1980 | Ishimoto et al. | 72/17 |
| 4,222,254 | 9/1980 | King, Jr. et al. | 72/8 |
| 4,428,054 | 1/1984 | Aizawa et al. | 72/8 |
| 4,428,244 | 1/1984 | Takeda | 72/17 |
| 4,531,392 | 7/1985 | Puda | 72/10 |
| 4,545,228 | 10/1985 | Yamaguti et al. | 72/16 |

*Primary Examiner*—Lowell A. Larson

*Assistant Examiner*—Steve Katz

*Attorney, Agent, or Firm*—Elroy Strickland

[57] ABSTRACT

A method of eliminating thickness changes in material exiting a stand or stands of a rolling mill, the changes being caused by the eccentricity of one or more rolls of the mill. The method includes the steps of engaging the material with a device that measures the tension of the material entering or leaving the mill and using said device to measure directly a change in the tension of the material due to roll eccentricity. Samples of the change in tension are provided during the time required for a roll of the mill to make one revolution. The samples are then processed by characterizing them as frequency, magnitude and phase angle components of the change in tension. The components are then used in an update algorithm to provide a current estimate of a cyclically occurring change in tension. The current tension change is converted to an estimated thickness change, and processed in a manner that returns the same to a time-based value; the time-based value is used to correct for roll eccentricity by controlling the working gap of the mill in synchronism with currents of roll eccentricity such that the effects of eccentricity are offset.

2 Claims, 2 Drawing Figures

ROLLING MILL ECCENTRICITY COMPENSATION USING MEASUREMENT OF SHEET TENSION

BACKGROUND OF THE INVENTION

The invention relates generally to the control of rolling mills in a manner that offsets the cylic effects of roll assemblies on the thickness of material being rolled, hereinafter referred to as eccentricity.

A system for controlling the effects of roll eccentricity in a rolling mill is disclosed in U.S. Pat. No. 4,222,254 to King et al, the disclosure of this patent being incorporated herein by reference. An improvement in the King et al system is disclosed in pending U.S. Ser. No. 591,277, filed Mar. 19, 1984 in the name of Mark Puda, now U.S. Pat. No. 4,531,392. The disclosure of the Puda patent is also incorporated herein by reference.

Both the King et al and Puda disclosures employ a process by which the eccentricity of one or more roll assemblies of a mill is inferred by making mathematical estimates of eccentricity. Estimates of eccentricity are made because the actual eccentricity of the rolls is not readily observable.

The estimates made in the King et al patent and the Puda patent are based on measurements of changes in the force at which the rolls of the mill engage the material being rolled in the mill, measuring changes in the stretch or compression of the mill housing during the rolling process and measuring changes in the position of the actuator mechanisms (mechanical screws or hydraulic cylinders) that control the working space and rolling force of the mill. These measurements are then used in a gaugemeter equation to estimate changes in the thickness of the material exiting the mill due to roll eccentricity.

The estimating process is continuous until the cyclic component in exit thickness due to roll eccentricity is reduced to a minimum or zero amount and the estimate of eccentricity reaches a steady state value representing the true eccentricity of the rolls.

As discussed in the Puda patent, the load cells and actuator mechanisms of the mill do not respond as fast as the occurrence of the eccentricity disturbance at high travel speeds of the material through the mill. Hence, the resulting control signals of the system can contain a delay in their response to eccentricity. The Puda disclosure cares for this by a process of developing phase compensated gains that are used to modify the amplitude and phase of the estimate of eccentricity calculated by the means disclosed in the King et al patent. The control signals directed to the actuator mechanisms of the mill are thereby phase corrected to care for the delay in the response of the load cells and actuator mechanism.

BRIEF SUMMARY OF THE INVENTION

Instead of inferring estimates of roll eccentricity from measurements of rolling force and the positions of actuator mechanisms in a process to control the effects of eccentricity, the present invention continuously measures the tension of the material entering or exiting the mill to indicate directly cyclic changes in the thickness of the material due to roll eccentricity. The measurements of tension are then employed to offset the effects of eccentricity on the thickness of the material being rolled in a manner described in detail below.

BRIEF DESCRIPTION OF THE DRAWINGS

The invention, along with its objectives and advantages, will be best understood from consideration of the following detailed description and the accompanying drawings in which:

FIG. 1 thereof is a flow diagram showing certain control means of the above King et al patent and the above Puda patent in combination with the tension measurement system of the present invention, while

DETAILED DESCRIPTION OF THE PREFERRED EMBODIMENT

Figure 1:
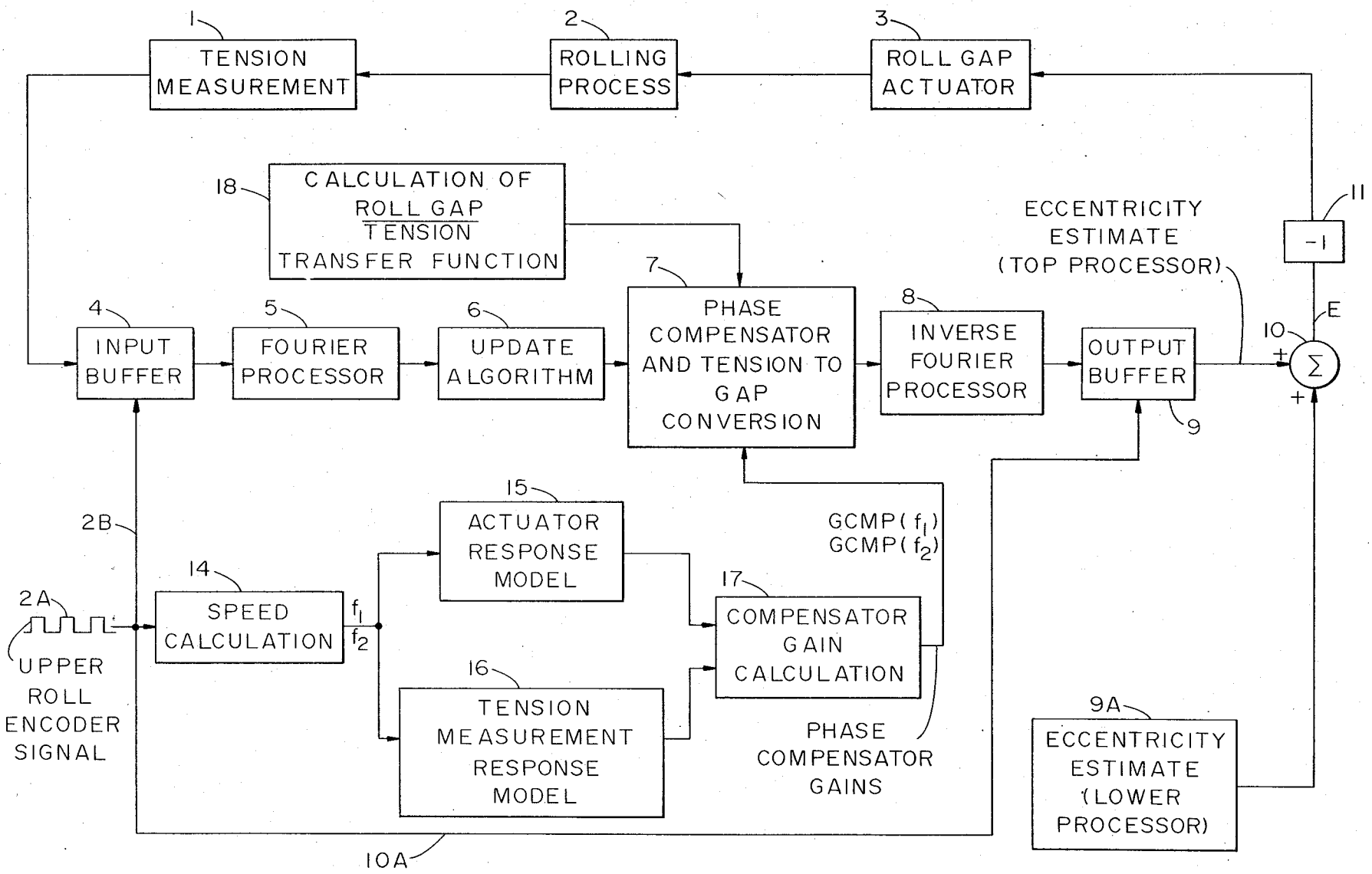
Figure 2:
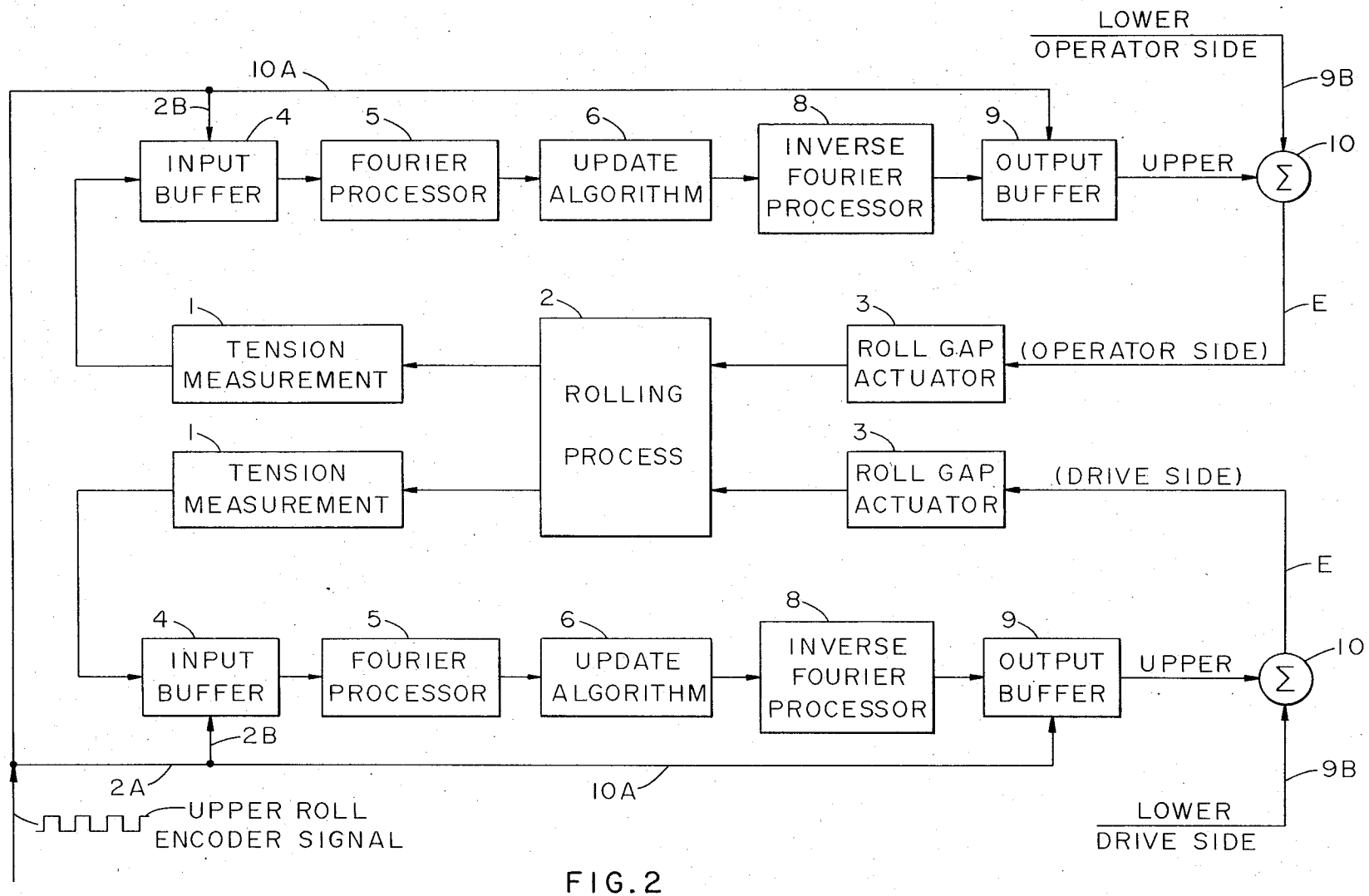
FIG. 2 is a flow diagram showing tension measurement for "operator" and "drive" sides of a rolling mill.

Referring now to the drawings, the figures thereof show diagrammatically Fourier processors and an update algorithm of the King et al patent along with the phase compensation scheme of the Puda patent to provide estimates of roll eccentricity. However, instead of using the rolling force, housing stretch and actuator position measurements employed in these disclosures, the present invention locates a tension measuring device 1 (FIG. 1), such as a tension bar (not shown) and two load measuring transducers (labeled 1 in FIG. 2) disposed at the ends of the bar, to provide data for estimating eccentricity. The tension bar includes a roller that runs in direct contact with a sheet of material entering or leaving a rolling mill, process 2 in the figures; the two transducers 1 in FIG. 2, located at the ends of the bar, measure directly the force on the bar, and by inference, the tension on both sides of the sheet. As shown in FIG. 2, a rolling mill has two sides, i.e., an "operator side" (on which are located operating personnel) and a "drive side" (on which are located the driving motors of the mill). Transducers 1 are hence located respectively on the operator and drive sides of the mill. Actuator mechanisms 3, which control the working space or gap of mill 2, are also located on the operator and drive sides of the mill.

Any eccentricity in the rolls of a mill changes the thickness of the sheet being rolled in the mill. This change in thickness changes the tension of the sheet entering and leaving the mill. Transducers 1, in the present invention, sense this change in tension and output signals that are employed to offset eccentricity of both upper and lower rolls in a manner presently to be explained.

In the drawings, rectangles are used to indicate the processes of the above King et al patent and Puda patent, as well as the processes of the subject invention. In addition, two such arrangements are required, one for each, upper and lower, roll assembly of a rolling mill. The arrangements are identical, however, so that only one is shown in detail in the drawings, the other is exemplified in FIG. 1 by a single box 9A. In FIG. 2, lower roll estimates are shown by lines 9B.

More particularly, FIG. 1 of the drawings shows the tension measurement of 1 directed to an input buffer 4 of a digital computer; the computer is not otherwise depicted in the drawings except by the boxes shown in addition to that of 4; the processes represented by the boxes are described in detail hereinafter.

The output of the tension measurement of 1, i.e., of each transducer in FIG. 2, is an analogue signal and includes a measurement of the tension change caused by eccentricity of one roll assembly of the rolling mill process 2, as the eccentricity is reflected in the changing thickness of the material exiting the mill. It is also an estimate of material tension, as developed in a manner presently to be explained. It is this signal that is fed to input buffer 4.

Each roll is fitted with a pulse encoder, as shown schematically in the King et al patent, that generates a series of pulses 2A (from an upper roll in the drawings), each pulse corresponding to a position increment of the revolution of the roll. Such pulses are directed to input buffer 4 (via line 2B in the drawings), and, upon receiving each pulse, the buffer samples the measurement of tension change being directed to the buffer from the transducers of measurement 1. The buffer also stores the measurement. This process continues for every pulse received by 4 until one complete revolution of the roll has occurred. At this time, the data (i.e. the estimates) stored in 4, which now represents a complete cycle of changing thicknesses due to roll eccentricity, is transferred to a Fourier processor 5 of the computer. The processor transforms the data into a set of complex numbers that represent separate and distinct frequency, amplitude and phase angle components of the change in tension during each revolution of the roll. The frequency component includes both fundamental and harmonics thereof.

The components provided by the Fourier process of 5 are now directed to an algorithm 6 that continuously updates the components to provide current estimates of changes in thickness. The details of this algorithm are described in the King et al patent. By means of an inverse Fourier transform 8, the components provided by Fourier transform 5 and updated by algorithm 6 are changed back to a revolution based signal and applied to a mill actuator 3.

The revolution based signal of 8, however, is first incrementally stored in an output buffer 9 of the computer and sequentially directed to a summing junction 10 on the occurrence of each pulse 2A received from the backup roll encoder. Line 10A in the figures indicates such directing of the pulses to buffer 9. The output of buffer 9 is a series of values that correspond to the eccentricity estimates of the upper backup roll of the mill. A similar set of values is provided for the lower backup roll, as indicated by box 9A. The processes of 9A are the same as those described above in connection with the Fourier transform and update algorithm such that they need not be depicted in detail in the drawings.

The output of 9A is also directed to summing junction 10. Junction 10 adds the values received from each output buffer to provide an estimate E that is the combined eccentricity of all rolls. This estimate is then employed to regulate the position of the mill actuator 3 in an equal but opposite direction effected by immersion of E at 11, to the actual eccentricity which results in cancellation of the effects of eccentricity on the material exiting the mill. As shown in FIG. 2, an estimate E is provided for both sides of the mill such that the actuator 3 on each side is appropriately controlled.

As explained in the Puda patent, however, mill actuators and load cells that measure rolling force cannot respond as rapidly as the occurrence of thickness changes due to roll eccentricity; a phase lag is thereby introduced into the system for controlling the mill in a manner to offset roll eccentricity. Puda cares for this (in FIG. 1) by phase compensation before the output of the update algorithm of 6 is passed to the inverse Fourier processor 8. Box 7 represents this compensation in FIG. 1. The compensation is effected by first calculating the rotational speed of the upper roll at 14, using the frequency of the pulses 2A issuing from the pulse encoder, or by using a separate speed measurement, and providing models of the dynamic responses of the mill actuators and force measuring cells. (This same procedure is performed for the lower roll.) As, explained further in the Puda patent, these models are stored equations representing dynamic responses of the actuators and load cells.

The calculation made at 14 provides a value that is the precise error introduced into the system at each of the eccentricity frequencies, fundamental and harmonic, by the actuators and load cells of the mill. In the Puda patent, this data is available at 15 and 16 in FIG. 1 of the patent and provides a calculation of phase compensator gain at 17; this gain is used to correct at 7 the phase of the value input to the inverse Fourier processor 8.

In the present invention, the gain provided by 17 is still used except that the response model of the load cells of the mill is replaced by that of a model 16 representing the dynamic response of the transducers of 1, i.e., these transducers exhibit an inherent lag in their response to changes in strip tension. The mathematical processes for determining this lag and error are the same as that for determining the lag of the load cells of the mill.

The cyclic changes in tension sensed by transducers 1 must now be transformed or converted to a roll gap function. This is accomplished, i.e., calculated, at 18. A calculation is made at 18 of the transfer function that equates using known rolling theory, a change in roll gap with a change in tension of the material being rolled. The calculated value at 18 is a gain term that is directed to phase compensator 7 so that the output thereof represents estimated roll gap or roll eccentricity instead of tension.

With the compensation effected at 7, the estimate of eccentricity at 10, as provided by the output of transducers 1, is in phase with the eccentricity of the rolls such that the eccentricity can be correctly offset by positioning the actuators 3 in equal but opposite direction to the estimate of eccentricity. This is effected by having the eccentricity information from the output buffers and from summing junction 10 synchronously correct with respect to the actual occurrence of the changes in thickness occurring in the mill. In this manner, the positions of the mill actuators 3 are changed to offset the effects of roll eccentricity; the material exiting the mill is thereby free of undulating, cyclic changes in thickness due to eccentricity.

While the invention has been described in terms of preferred embodiments, the claims appended hereto are intended to encompass all embodiments which fall within the spirit of the invention.

What is claimed is:

1. A method of eliminating thickness changes in material exiting a stand or stands of a rolling mill comprised of one or more stands, the thickness changes being caused by the eccentricity of one or more rolls of the mill, the method comprising the steps of:

directing material through the mill, engaging the material with a device that measures the tension of the material entering or leaving the mill, using said device to measure directly a change in the tension of the material due to roll eccentricity, providing samples of said change in tension during the time required for a roll to make one revolution, processing said samples of change by characterizing them as frequency, magnitude and phase angle components of the change in tension using a Fourier transform function, using said components in an update algorithm to provide a current estimate of a cyclically occurring change in tension, converting said tension change to a current estimate of thickness change, processing the current estimate of thickness change in a manner that returns the same to a time based value using an inverse Fourier transform function, and using said time based value to correct for roll eccentricity by controlling the working gap of the mill in synchronism with the occurrence of roll eccentricity such that the effects of roll eccentricity are offset.

2. The method of claim 1 in which the step of measuring the changes in tension of the material includes the step of measuring such changes at the operator and drive sides of the material.

* * * * *